United States Patent [19]

McComas et al.

[11] 4,394,896

[45] Jul. 26, 1983

[54] BACKLOG CONTROL SYSTEM FOR PROCESSING MACHINE

[75] Inventors: Jerry L. McComas, Sunnyvale, Calif.; Donald C. Crawford, Green Bay, Wis.

[73] Assignee: FMC Corporation, Chicago, Ill.

[21] Appl. No.: 168,834

[22] Filed: Jul. 29, 1980

[51] Int. Cl.[3] ..... B65G 43/00

[52] U.S. Cl. ..... 198/341; 198/572; 198/577; 53/494

[58] Field of Search ..... 198/341, 460, 461, 503, 198/358, 356, 502, 572, 573, 577, 579; 53/494; 235/92 CT, 92 T, 92 PK, 92 EV

[56] References Cited

U.S. PATENT DOCUMENTS

| | | | |
|---|---|---|---|
| 3,122,231 | 2/1964 | Pence et al. | 198/358 |
| 3,212,622 | 10/1965 | Metz | 198/460 |
| 3,944,049 | 3/1976 | Graybill | 198/460 |
| 4,135,346 | 1/1979 | Rebsamen | 53/494 |
| 4,197,935 | 4/1980 | Aterianus et al. | 198/461 |

*Primary Examiner*—Joseph E. Valenza

*Attorney, Agent, or Firm*—Louis J. Pizzanelli; Richard B. Megley

[57] ABSTRACT

An article backlog control system for a processing machine such as a wrapper maintains a backlog count within a preselected range. Articles being randomly supplied to the backlog are continuously counted as are articles being removed from the backlog for processing, the difference between article counts is continuously determined and the speed of the processing machine is controlled by the system on the basis of the count difference in order to maintain the backlog within the preselected range.

9 Claims, 13 Drawing Figures

STOPPED

NOMINAL

SLOW

FAST

BACKLOG CONTROL SYSTEM FOR PROCESSING MACHINE

FIELD OF THE INVENTION

This invention relates to article feeding and more particularly to the controlling of the backlog row of articles being fed to an article processing machine.

DESCRIPTION OF PRIOR ART

The U.S. Pat. No. to Aterianus et al 4,197,935, Apr. 15, 1980, discloses the automatic feeding of spaced articles to a processing machine, such as a wrapper, wherein the articles are introduced into the wrapper by a lug infeed conveyor which receives articles from a metering conveyor, both conveyors being synchronized with the operation of the wrapper. The article backlog is formed on an accumulating conveyor and the backlog control is provided by article position sensors disposed along the accumulating conveyor, which adjust the speed of the wrapper, infeed and metering conveyors in order to maintain the desired backlog. This patent is assigned to the assignee of the present invention.

The U.S. Pat. No. to Rebsamen 4,135,346, Jan. 23, 1979, discloses apparatus for controlling the speed of a packaging machine. Articles are supplied to the packaging machine by a feeder belt 4 driven by the machine and by a separately driven input conveyor 2. The packaging machine is driven by a motor 6, the speed of which is controlled by a speed control system 7.

Upper and downstream sensors T1 and T2 determine whether an article is present or not at each of two predetermined points on the input path to the packaging machine. The upstream sensor T1 normally provides pulses as articles pass the sensor, which pulses are integrated to provide a DC control signal for the wrapper motor. In normal operation, the articles are in contact at the downstream sensor T2 so that the latter provides a fixed amplitude DC pulse signal which closes a switch 12 and permits the upstream sensor T1 to control the packaging machine motor speed.

If the backlog does not extend back to the downstream sensor T2, the continuous pulse from the latter is interrupted and the motor switch 12 is opened to stop the packaging machine motor after a time delay determined by a timer 14. When a solid row backlog has built up to a point that again provides a signal from sensor T2, the packaging machine motor is restarted after the same time delay.

SUMMARY OF THE INVENTION

The backlog control system of the present invention is, within the system limits, a control which provides a large number of speed variations, that is, it is a "fine" control.

Instead of basing the control speed of the system upon the physical detection of the position of articles forming the backlog and upon the position of articles approaching the backlog, the backlog control of the present invention provides voltage and current control signals that are based solely upon the counting of pulse or digital signals represented by the passage of each individual article across a sensor or pulse generator.

In the broader aspects of the invention, articles being randomly supplied to a conveyor in the system, herein referred to as an "accumulating conveyor", are successively counted and the resultant counts are temporarily stored. When the article processing machine, such as a packaging machine or a wrapper is in operation, the articles entering the machine are also successively counted.

Basically, the system of the present invention embodies an accumulating counter system that continuously adds "count-up" counts of articles supplied to the backlog (after a time delay). The counter system also continuously takes the difference between the count-up counts and backlog removal or "count-down" counts generated by introduction of articles to the processing machine from the backlog. The resulting count difference, the "accumulated count difference" is employed to generate a control signal for determining the speed of the processing machine and the corresponding rate of backlog removal.

In the embodiments to be described, the accumulated count difference is determined by subtracting the count-down (backlog removal) counts from the count-up (article supply) counts and if this difference is positive and more than zero a control signal is produced which will keep the processing machine running at a speed which will provide the desired backlog. In the broader aspects of the invention the aforesaid subtraction could be reversed and the resultant control signal reversed in sign to attain the same results.

In the backlog control system of the present invention, unprocessed articles are supplied at random intervals to an article receiving portion of a conveyor (e.g., the accumulating conveyor) but the latter is set to run at some predetermined fixed speed which speed may be selected in accordance with the length of the articles and a normal or optimum speed of the processing machine.

Articles from the accumulating conveyor are received by an infeed conveyor which runs in synchronism with the processing machine and which delivers articles at a uniform spacing to the machine. The number of unprocessed articles disposed between the processing machine and a selected zone at the accumulating conveyor is known as the backlog. In accordance with the present invention, a preselected number or count of articles is maintained in the backlog, within a predetermined range of counts, and the desired backlog conditions are maintained solely by automatically adjusting the speed of the processing machine and an infeed conveyor synchronized therewith. The accumulating or supply conveyor runs at a preselected constant speed.

As mentioned, the aforesaid regulation of processing machine speed, in order to maintain a backlog containing a predetermined number of articles within the selected range, is provided by simply counting the articles as they are supplied, counting them as they enter the processing machine and continuously subtracting one count from the other.

The provide a correspondingly "fine" control employing sensors which merely sense the position of the articles forming the backlog would require the installation of a row of article sensors along the backlog formation zone and at spacings equal to article length, with attendant multiple and interlocking control circuits. In addition, such a multiple sensor system would require a re-positioning of all the sensors whenever changes are made in the length of the articles being supplied. The two sensor, article counting system of the present invention provides a "fine" control without the aforesaid article position sensor intricacies and difficulties.

Another feature of the backlog control system of the present invention, wherein the articles need only be counted, is that the system lends itself to the use of manual control settings which, when taken together, form an optimum control pattern or "curve". This curve can be set into the system so as to take into consideration a nominal or optimum processing machine speed, a preselected rate of article supply to the system, a minimum and a maximum backlog and a threshold or "plateau" count wherein the processing machine speed remains constant over preselected variations in the article supply rate. These control settings are introduced into the system as simple article counts and can be displayed as such at the controls. In other words, by merely setting in preselected article counts and other required settings an operator can, in effect, draw a "tailor made" control curve which represents various critical stages in the control of processing machine speed.

The system of the present invention has an article supply detector which provides a backlog control signal based on counts of the unprocessed articles as they are supplied to the system. The system takes advantage of the counting technique in the establishment of a reference point for actual backlog position at some selected backlog position, such as a backlog position at which the article processing machine is to be started.

The system of the present invention requires no backlog position sensor to attain the aforesaid advantage. Since incoming articles are individually counted, these article-supply counts enter a time or count delay circuit which delivers a corresponding article count to the backlog control after a period of time that corresponds to the time required for the accumulating conveyor to transport an article from the position of the supply counter sensor to the selected backlog position, thereby precluding the need for an article sensor at the latter position in order to control the backlog. The count delay feature makes it possible to position the supply count (count-up) sensor upstream of the largest expected backlog, a position at which the supplied articles are normally spaced and hence are easily counted.

DETAILED DESCRIPTION

Figure 1:
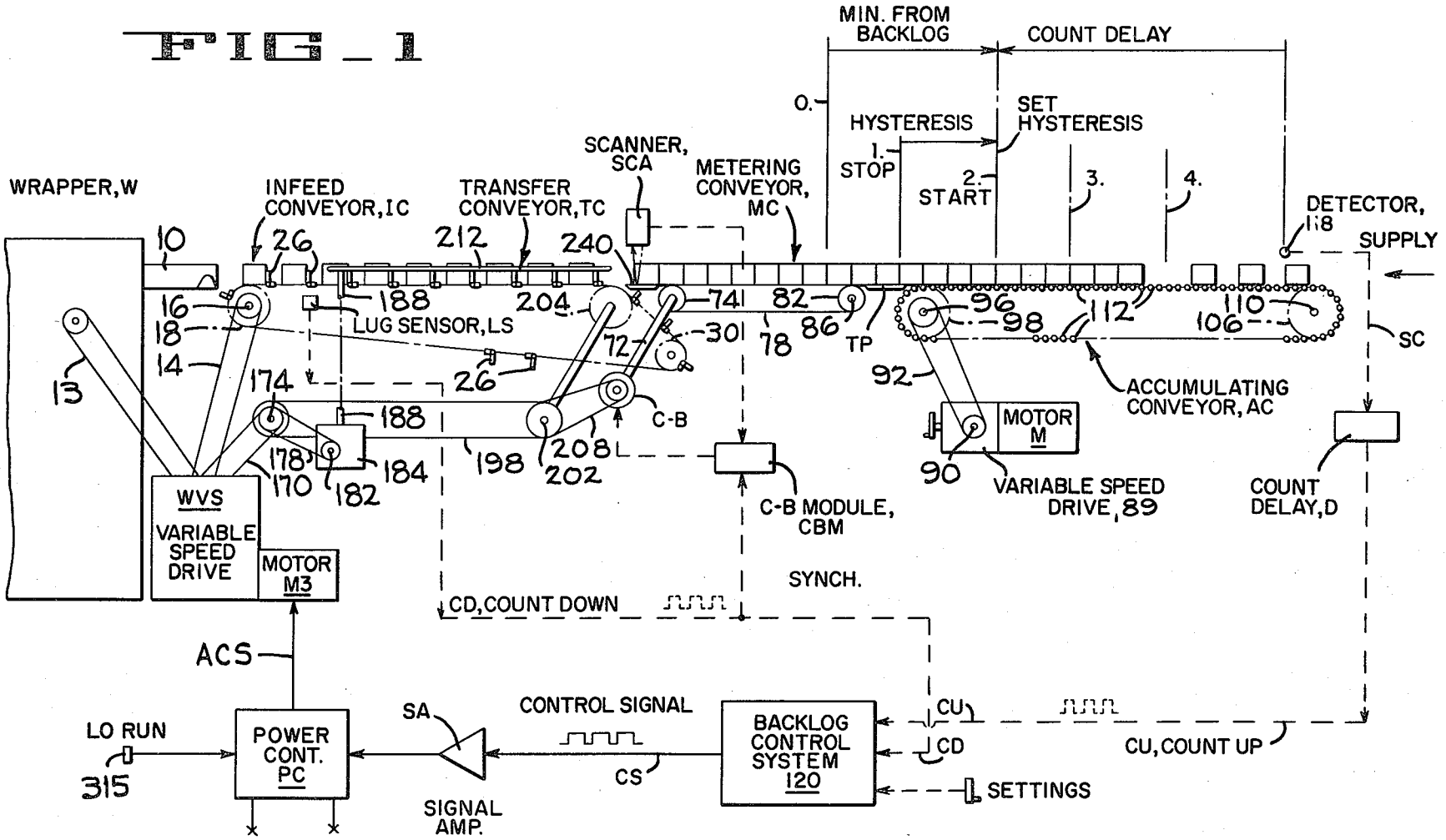
FIG. 1 is a diagrammatic drawing of a backlog control system of the present invention emloyed for controlling an article wrapper.

FIG. 1 is a schematic diagram of a backlog control system embodying the present invention employed to control a backlog of articles supplied to an article wrapper. The mechanical system disclosed in FIG. 1 is like that disclosed in the aforesaid U.S. Aterianus Pat. No. 4,197,935 and particularly the embodiment shown in FIGS. 10–16. Only enough of the structure of the various conveyors and drives will be shown to facilitate an understanding of the invention and a detailed description thereof can be found in the aforesaid Aterianus et al patent, the subject matter of which is incorporated herein by reference.

In the embodiment of the invention being described, the articles to be processed are fed to a wrapping machine or wrapper W while being pushed along a chute 10. The article supply path includes a lugged infeed conveyor IC, a metering conveyor MC and a transfer conveyor TC which transfers articles from the metering conveyor MC to the infeed conveyor. The conveyors just mentioned are all driven in synchronism with the wrapper W by a variable speed drive WVS driven by a motor M3.

For ease of cross reference the same reference numbers are employed in FIG. 1 as are employed in FIG. 10 in the aforesaid Aterianus patent in relative corresponding structure. The wrapper W is driven from the variable speed drive WVS by a drive 13 and the infeed conveyor IC is driven by a drive 14 which drives a shaft 16 that mounts the conveyor drive sprocket 18. The infeed conveyor has spaced lugs 26 for advancing articles in uniformly spaced relation into the wrapper and these lugs are mounted on chains or the like which pass around direction changing sprocket 204 and idler sprocket 30.

The metering conveyor MC is driven from the variable speed drive by a drive 170 which drives a shaft 174 and a drive 198 which drives an intermediate shaft 202. A drive chain 208 or the like is driven by shaft 202 which drives a clutch brake C-B for operating the drive shaft 72 and a drive pulley 74 for the belt 78 of the metering conveyor MC. The metering conveyor belt passes around an article receiving pulley 82 on a shaft 86.

Articles are transferred from the metering conveyor to the infeed conveyor by a transfer conveyor TC which comprises opposed endless belts, only one belt 212 appearing in FIG. 1. The transfer conveyor belts are driven from the aforesaid shaft 174 by a drive 178 which drives an input shaft 182 for a gear box 184. The gear box has two output shafts such as the shaft 188 shown in FIG. 1 for driving the transfer conveyor belts 212.

As explained in detail in the aforesaid Aterianus et al patent, a clutch-brake control system is employed for driving the infeed conveyor IC in a manner whereby its article pushing lugs 26 can pick up articles received from the metering conveyor without interference between the lugs and the articles. The details of this synchronization are not critical to the present invention and the system illustrated employs a scanner SCA which includes a light source and a photocell that can receive light reflected from a reflector 240 between the metering and infeed conveyors. Also, in the aforesaid synchronization system is a lug sensor LS, the purpose of which is to provide a pulse each time a lug 26 passes the sensor. Since each lug advances an article when the system is operating normally, the lug sensor can also be considered as a device for counting articles entering the wrapper. Signals from the lug sensor and from the scanner both enter a C-B module CBM which in turn controls the engagement of the clutch and disengagement of the brake in the clutch brake unit C-B.

The aforesaid system merely insures that the metering conveyor MC will position articles picked up by the transfer conveyor when those articles are longitudinally positioned just ahead of a lug 26 on the infeed conveyor. The important aspect of the lug sensor LS with respect to the control system of the present invention is that the pulses on the lug sensor represent count signals of articles entering the wrapper, which signals are referred to as count-down signals CD. In the aforesaid Aterianus application, the lug sensor is shown as being operated by a cam mechanically driven by the variable speed wrapper drive at a speed which insures that it will operate a limit switch each time an infeed conveyor lug passes a given point. In FIG. 1 the lug sensor is illustrated as being a magnetic or capacitance sensor which provides a pulse each time a lug 26 passes the sensor and therefore provides the aforesaid count-down signals. Insofar as the present invention is concerned, it is immaterial which mode of article counting is employed.

In the control system of the present invention, the accumulating conveyor AC is driven by a motor M and a variable speed drive 89, the speed of which can be adjusted by the operator to correspond to article size and the nominal expected supply rate of articles. The output shaft 90 of the drive has a chain 92 which turns the shaft 96 mounting the drive sprocket 98 for the flexible chains or other elements forming the accumulating conveyor. Conveyor chains pass around idler sprockets 106 on a shaft 110 and mounted between the chains are articles supporting rollers 112 which are freely rotatable so that the rollers can permit the conveyor to move under a solid backlog of articles without exerting undue pressure thereon.

An article detector 118 is provided at the article receiving or supply side of the accumulating conveyor and it provides a supply count pulse SC each time an article passes the detector. The article supply count pulses SC enter a count delay circuit D which delivers one delayed count-up count CU each time it receives a supply count pulse SC, but after elapse of a predetermined delay time between the entry of a given article supply count pulse SC and its delivery as the count-up count CU for the counted article.

The count-down counts or pulses CD from the lug sensor LS and the count-up pulses CU from the supply detector 118 and delayed by the delay D both enter the backlog control system 120 of the present invention. Various system condition settings can be introduced into the control system by the operator as will be described presently. The backlog control system continuously compares the article counts received from the aforesaid sensors and converts the digital counts into an analogue control signal CS in the form of a pulsating DC control voltage or current. The control signal enters a signal amplifier SA and is passed on to a power control system PC of conventional construction which provides an amplified control signal ACS for the motor M3 that drives the wrapper as well as the infeed and metering conveyors.

It can be seen from FIG. 1 that the control system of the present invention is a closed loop system in that it compares article counts from the lug sensor and from the supply detector, producing an analogue control signal representing the results of this comparison, e.g. their difference. This provides a control signal for the wrapper drive, which in turn provides an analogue response to the wrapper and to the infeed conveyor. The control system of the present invention operates on the basis of article counts as they pass the two sensors and not upon the position of either sensor along the article feed supply path.

Control Panel

Figure 2:
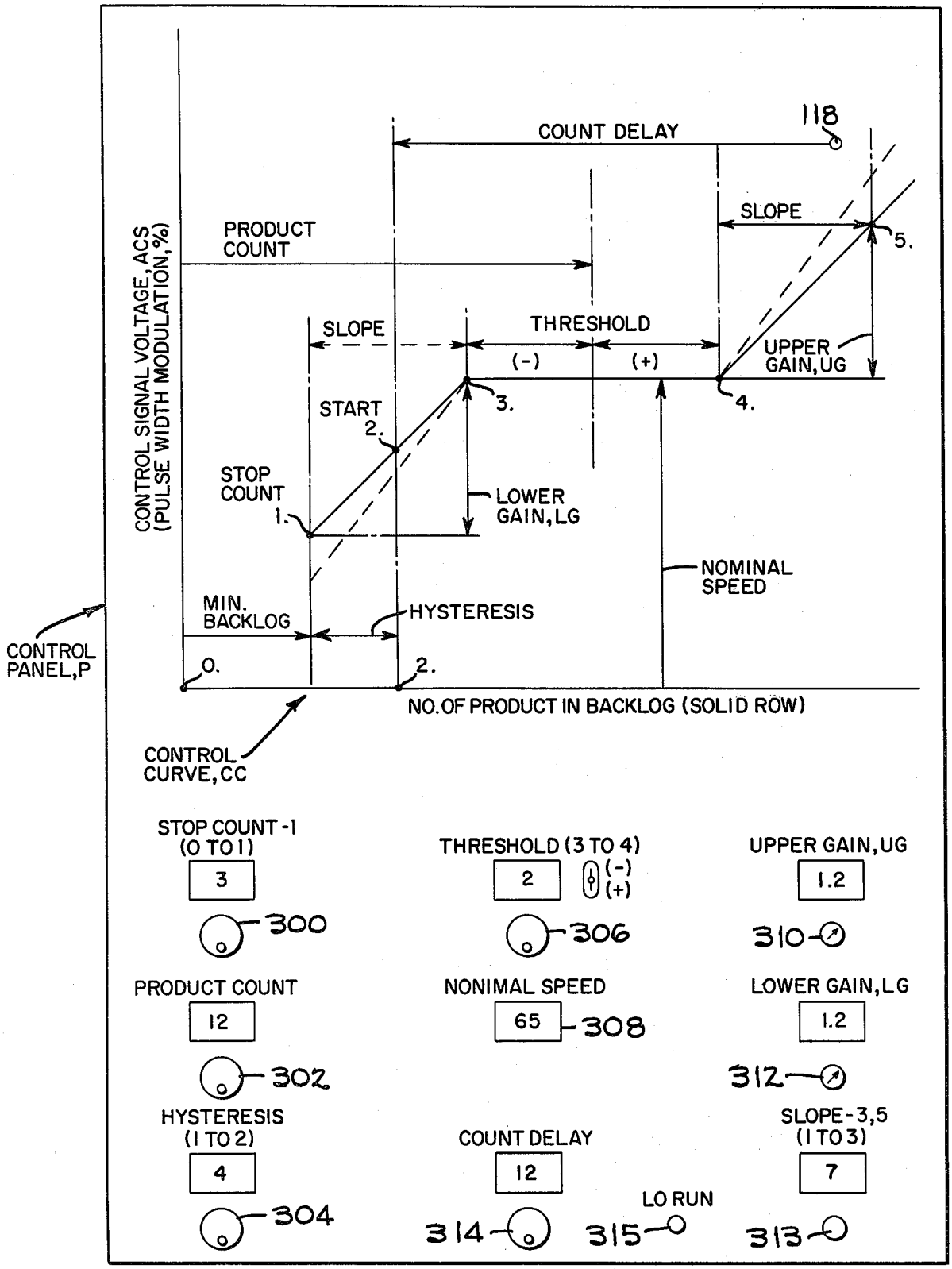
FIG. 2 is a diagram of the control system panel showing the control curve and indicating some of the control system settings.

FIG. 2 is a simplified diagramatic view of an example of a control panel P which can be used to control the system of the present invention. Shown in enlarged form on the figure is a control curve CC which not only illustrates the principles of the control but which can be referred to by the operator when he makes the necessary settings into the system from the control panel or from other control units in the system.

Referring to the control curve, it abscissa is a count of the number of products in the backlog, the term "backlog" referring to a row of articles which are in end-to-end abutment along the metering and accumulating conveyors. The ordinate of the control curve represents the control signal voltage ACS which can also be referred to as the pulse width modulation percent in a control system embodying the present invention.

The control curve illustrates a stop-count point 1 which represents the minimum backlog of articles from a selected position in the system. In this case, the minimum backlog is measured from a zero position at a transport plate TP at the article receiving end of the metering conveyor MC. The curve has an ascending line from the "Stop" point 1, referred to as the lower gain Slope LG which represents a progressively increasing voltage signal as the number of products in the backlog increases. This line passes through a "Start" point 2 and terminates at a point 3. The abcissa of the slope equals the count difference between point 3 and point 1 and point 3 represents initiation of a Threshold or plateau portion of the curve. Also shown between points 1 and 3 is an article count referred to as Hysteresis which represents the number of articles between the "Stop" point 1, which in the example given is at the upstream edge of the transfer plate TP (FIG. 1) to the Start point 2 on the lower gain slope.

A Product Count is set in which represents a preselected number of articles in the backlog from the zero position. It determines the "nominal" length of the backlog, that is the backlog count about which the backlog can increase or decrease slightly while the wrapper runs at its normal speed.

A Threshold or "plateau" in the control curve is illustrated as a horizontal line between points 3 and points 4. The height of this line represents the optimum or Nominal Speed of the processing machine, the wrapper in the embodiment being described.

The threshold count can be set in as a selected number of counts less than the Product Count, which determines point 3 on the curve, and a selected number of counts greater than Product Count, which determines point 4 on the curve. As will be seen, variation in the number of products in the backlog up or down from a Product Count setting between the threshold points 3 and 4 will not result in corresponding changes in the control signal voltage for the processing machine. Extending upward from point 4 is the upper gain curve UG which terminates at maximum wrapper speed at point 5.

The count for determining the abcissa of point 5 is equal to the difference between the count for point 1 and that for point 3, and hence can be set in by causing the logic circuit to perform that subtraction, thereby producing the slope count for point 5.

The geometric steepness or slope of both the lower gain and the upper gain curve can be varied by the setting of potentiometers in one embodiment or digital switches in another, as will be seen presently, and as indicated by the dashed lines on the curve.

Below the control curve on the control panel P are shown diagramatically a number of controls for setting in values indicated on the control curve and above each control has a analogue display window in which appears the count numbers set in by the various controls.

Thus, for example, the control panel will include a Stop Count control 300 with associated display, which sets in point one on the control curve abcissa and determines the minimum backlog from reference point zero. A Product Count control 302, sets in the Product Count. A Hysteresis count control 304, determines the position of start point 2. A Threshold control 306, is used to set in the number of Threshold counts above and below the Product Count. A Nominal Speed indicator 308 sets in a control signal voltage for operating the wrapper at a nominal speed. Also illustrated as being on the control panel are an upper gain control 310 and a lower gain control 312 which determines the steepness of curve portions LG and UG. A slope control 313 enters the number of counts between points 1 and 3, which have previously been determined by the Stop count setting (point 1), the Product Count setting and the minus (−) Threshold setting.

A Count Delay time, representing the time required for an article to travel from detector 118 to a selected point in the backlog zone, such as Start point 2, is set in by control 314.

A Lo Run button 315 is provided which initiates low speed operation of the wrapper, infeed conveyor, transfer conveyor and metering converyor for initial formation of a desired backlog.

Figure 3:
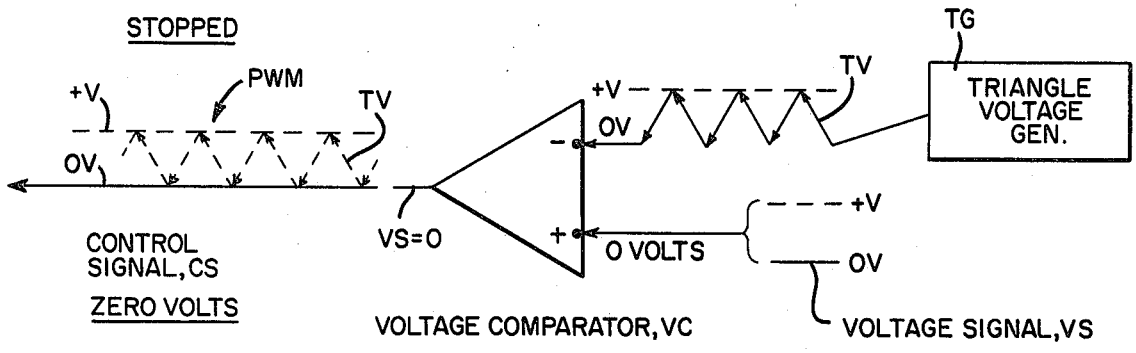
FIGS. 3–3C form a group of diagrams illustrating the principals of pulse width modulation.
Figure 3A:
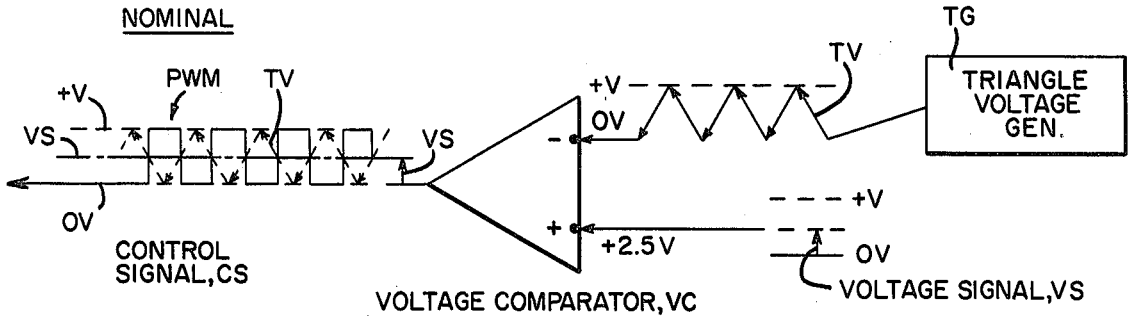
Figure 3B:
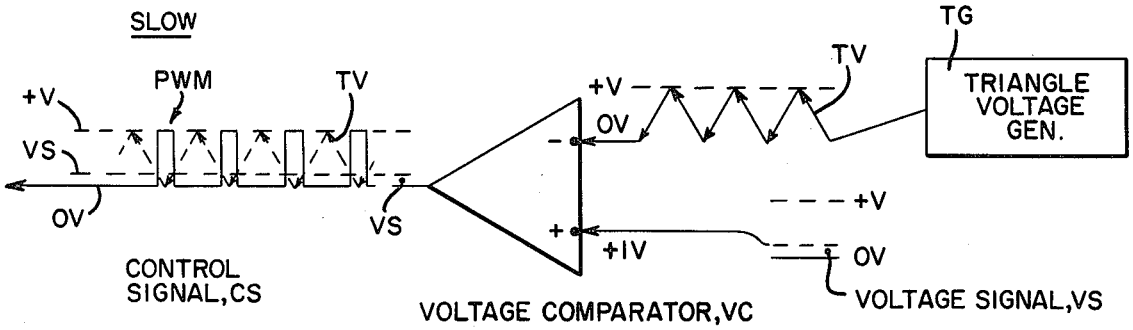
Figure 3C:
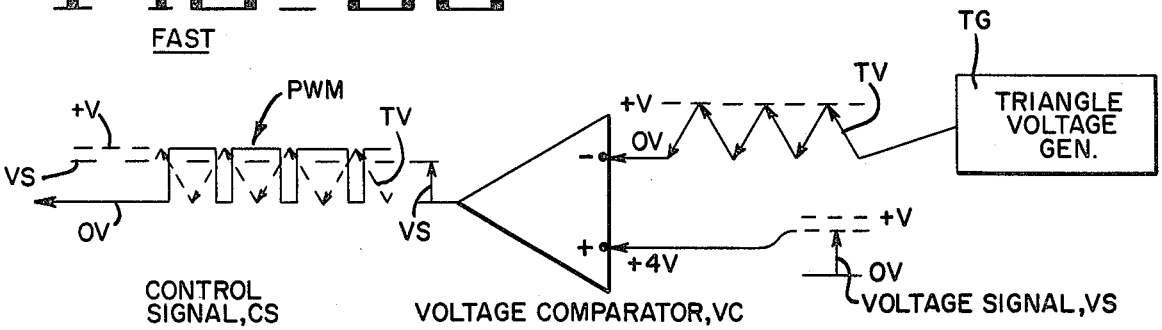

FIGS. 3–3C are a series of schematic diagrams illustrating the principle of operation of the pulse width modulator PWM. In the example given a function generator such as a triangle voltage generator TG, generates and continuously produces a triangular voltage wave TV which, in the form illustrated varies from zero voltage up to a positive voltage, such as 5 volts, and back along the wave form indicated in the Figures. The triangle voltage signal TV is connected to the negative (−) terminal of a voltage comparator VC, the output of which may be a simple biased transistor circuit that acts as a switch.

A voltage signal VS from the control system of the present invention, to be described presently, is applied to the positive (+) terminal of the voltage comparator VC. The signal voltage VS may vary from zero volts, representing a signal of zero, up to some positive value such as plus 5 volts, representing maximum or "fast" signal.

Referring to FIG. 3A, for example, the voltage comparator operates so that whenever the voltage TV from the triangle voltage generator exceeds the signal voltage VS the voltage comparator output is switched off, that is, it is at zero volts. The voltage comparator will deliver a control signal pulse CS only when the voltage of the triangle wave TV is below that of the voltage signal VS. Each control signal pulse is maintained during the time that the triangle generator voltage TV drops from a voltage equal to that of the signal voltage to zero and the rises again until it equals the voltage signal VS. The control signal voltage drops to zero when the triangle voltage TV rises to exceed the signal voltage and stays at zero until the triangle voltage drops below the signal voltage VS on a succeeding cycle.

Thus by comparing a DC voltage signal VS with a triangle generator voltage TV, a pulsating DC signal CS is provided. This signal has a form of a square wave which will periodically vary from zero volts up to the positive voltage of the signal and back to zero volts, but the duration of "width" of each pulse is determined by the voltage signal VS. The aforesaid action is referred to as "pulse width modulation", and the principle is illustrated diagrammatically by superposing the triangle voltage TV (dotted lines) on the voltage signal VS to produce a control signal CS.

The amount of current flowing in the control signal CS is dependent upon the width of duration of each pulse and when these portions are integrated or averaged out to form a DC control signal the strength of that signal is proportional to the width of the individual pulses from which it is formed, that is, to the percent of pulse width modulation.

In FIG. 3, the voltage signal is zero volts in which case the triangle voltage TV always exceeds the signal voltage and the comparator output is also zero volts, so that the pulse width modulator PWM provides a control signal CS of zero volts. As will be seen, under these conditions the processing machine or wrapper will be stopped.

In FIG. 3A, a positive voltage signal VS of 2.5 volts is applied to the voltage comparator of pulse width modulator, which signal represents about one-half of the total voltage signal discursion. Under these circumstances the pulse width modulation is about 50% and a normal or nominal control signal CS is provided by the modulator. This nominal signal represents operation of the wrapper controlled thereby at its preselected or nominal speed.

In FIG. 3B a slightly positive voltage signal VS of one volt is applied to the voltage comparator VC and narrow width positive pulses form the control signal CS. The averaging of these pulses of short duration provide a relatively weak control signal and result in slow speed operation of the wrapper. Under these conditions the percent modulation by the pulse width modulator is low.

In the diagram of FIG. 3C, the voltage signal VS is at a relatively large positive value of 4 volts and therefore the width of the pulses produced when that signal is combined with the triangular wave TV is relatively large. This represents a high percentage of pulse width modulaion with the resultant control signal causing the wrapping machine to operate at a fast speed, that is, faster than the normal or nominal speed represented by the diagram of FIG. 3A.

Backlog Control System

Figure 4:
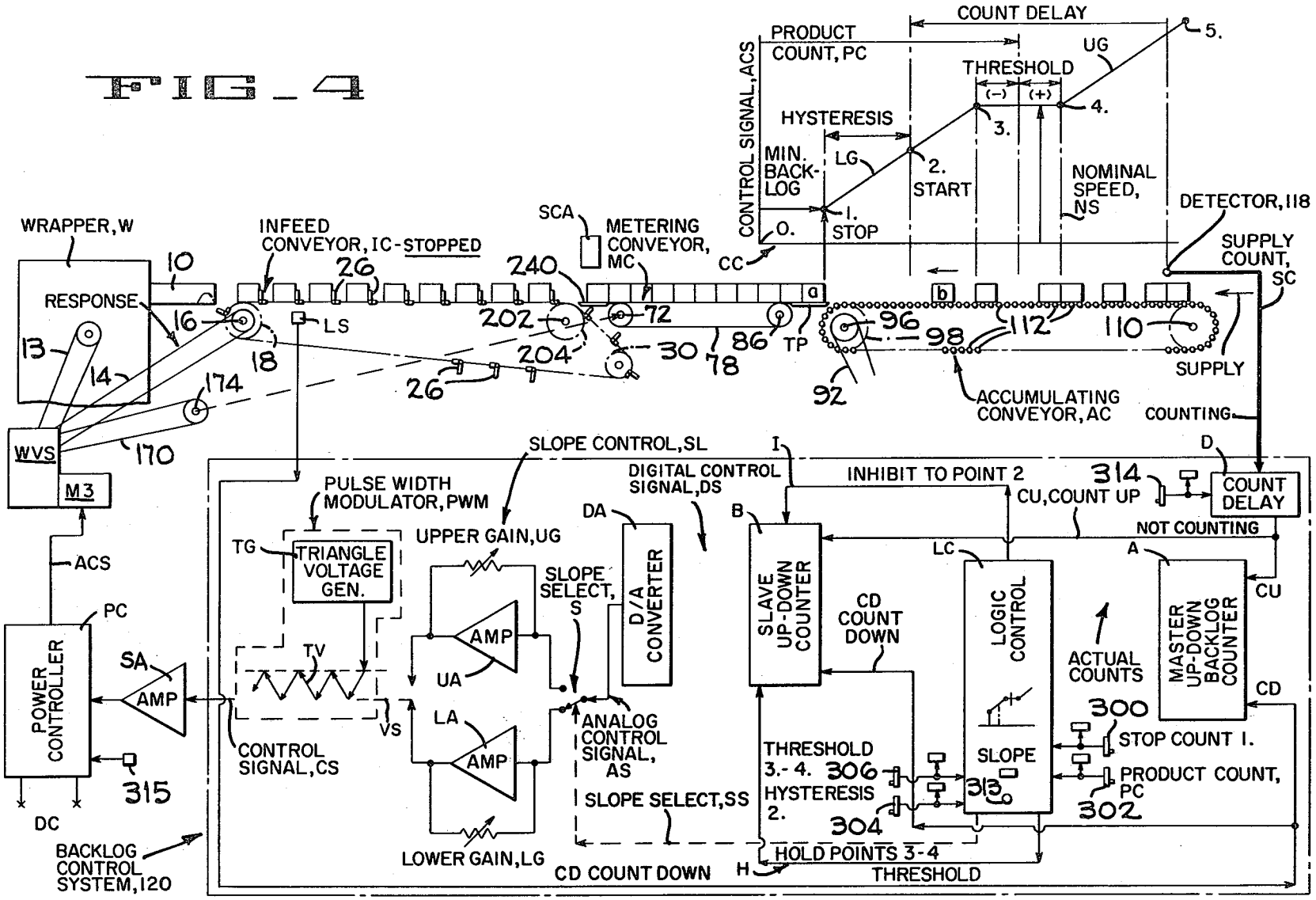
FIG. 4 is a diagram resembling that of FIG. 1 showing an embodiment of the backlog control system in more detail.

FIGS. 4–4D show the principal mechanical elements including the conveyors and the major drives described in connection with FIG. 1 necessary for an understanding of the control system. However, more of the backlog control system 120 is illustrated in these figures.

Except for simple manual digital settings made into the system the control system is entirely electronic and can be made up of state-of-the-art logic gates, logic circuits, registers, latches, flip-flops, digital-analogue converters, voltage converters, amplifiers, etc. In FIGS. 4–4D, the control curve CC previously mentioned in connection with FIG. 2 is super-imposed above the backlog zone of the accumulating and metering conveyors in order to facilitate explanation of the operation of the control system.

As previously mentioned, the basic principle of the control system is that of continuously taking the difference between the count-up counts CU initated at the count supply detector 118 at an upstream portion of the accumulating conveyor and the count-down counts CD from sensor LS, which, by sensing lugs 26 on the infeed conveyor, provides an infeed count pulse for each article as it is about to be delivered to the wrapper W. In the system of the present invention, the accumulation of the count-up and count-down counts is made in two "up-down" counters. Up-down counters are supplied to the trade as assembled integrated circuits. These counters receive the incoming counts from each source and have an output that continuously represents the difference between the incoming counts over a period of time.

In the circuit, a master up-down backlog counter A receives delayed count up-counts CU from a count delay circuit D. The purpose of the count-delay circuit, as illustrated in the control curve CC is to, in effect, transfer an actual article supply count SC to a downstream position along the accumulating conveyor such as the start position 2, shown in the curve. The count delay time between the entry of a count supply count SC and the delivery of a delayed count-up count CU from the count delay D represents the time which would be required for an article to be transported from the count supply detector 118 to a selected position such as the Start position 2 at the backlog.

The count-up signals CU, in addition to being delivered to the master up-down backlog counter A also are delivered to a slave up-down counter B, as can be seen in the drawings.

The lug sensor LS at the infeed conveyor IC delivers a pulse as each lug 26 approaches the wrapper W. Since a single article is being advanced by each lug, the lug sensor LS can be considered to provide count pulses for articles that are being delivered to a wrapper. These count pulses are the count-down counts CD and are delivered to both the master counter A and the slave counter B as illustrated in the drawings.

The counts resulting from the count comparison performed in the master counter A, which are referred to as actual counts in the drawings, are delivered to a logic control LC. The circuit details of the logic control are not illustrated because in the present state of the electronic control art, a person skilled in that art given directions as to the desired functions to be performed, can, with the exercise of ordinary skill in the art, assemble commercially available solid state or other electronic devices which will perform such functions. By performing certain basic simple operations, the logic control LC does, in effect, convert article count information into control count information in accordance with the control curve CC, previously described.

Most of the manual input settings introduced into the system and described in connection wih FIG. 2 are actually set into the logic control LC as digital switch settings, as indicated by the setting knobs and register windows shown at the lower portion of the logic control.

The logic control has three basic outputs, an Inhibit signal I directed to the slave counter B, a Hold or threshold signal H also directed to that counter and a Slope Select signal SS which operates an electronic slope select switch S for directing a control signal to a lower gain or an upper gain amplifier.

The slave up-down counter B receives the same count-up counts CU and count-down counts CD that are directed to the master counter A. However, the output of slave counter B differs from that of master counter A in that the number of counts from counter B, which represent the digital control signal DS, is determined by operation of the logic control and its Inhibit and Hold signals I, H. The counts from the slave counter B enter a D/A converter DA as digital counts and emerge therefrom as an analogue control signal AS, which by way of example, may have a voltage that varies from zero to some positive value, such as plus 5 volts DC.

A slope control circuit, SL receives signals AS from one pole or the other of the slope select switch S, amplifies those signals and passes them on to a pulse width modulator PWM. The slope control circuit includes a lower gain amplifier LA. the gain of which is adjusted by lower gain potentiometer LG and an upper gain amplifier UA having an upper gain adjustment UG. The amplified signal from the slope control circuit is referred to as a voltage signal VS which signal enters the pulse width modulator as a signal varying from zero volts to a positive DC voltage which corresponds to the output of the slave up-down counter B. The pusle width modulator PWM, also receives a triangular signal TV from a function generator such as a triangle voltage generator TG. The voltage signal VS and the triangular voltage signal TV are compared as previously described in connection with FIG. 3, by the voltage comparator VC which is omitted in FIGS. 4–4D to save space.

The pulse width modulator PWM provides a control signal CS to the signal amplifier SA as previously described in connection with FIG. 1. The amplified control signal is directed to the power controller PC which directs the amplified control signal ACS to the motor M3 for driving the wrapper, as previously described.

Operation

Although the infeed and metering conveyors IC, MC can initially be loaded by hand with a backlog of articles, initial loading can also be effected by depressing the low speed "LO RUN" button 315 on the control panel. This starts the wrapper and the conveyors IC, TC and MC at a speed, about equal to that of the Stop count speed at point 1 on the control curve. This manual control is continued until the desired backlog has built up, whereupon control is turned over to the automatic control system.

Automatic Minimum Backlog

Referring to FIG. 4, the backlog of articles along the infeed and metering conveyors IC, MC has dropped to a condition where the last article "a" of a solid row of articles running along the metering conveyor MC has just cleared the accumulating conveyor AC and is resting on the transfer plate TP, wih its trailing edge at the "Stop" point 1 on the control curve. This condition could occur upon temporarily shutting down the system or upon a prolonged interruption in the supply of articles to the accumulating conveyor AC.

Although articles are being introduced by the accumulating conveyor and are being counted by the count-up detector 118, thereby providing count-up supply signals SC to a count delay circuit D, the number of counts CU from the count delay have not equaled the Start count and the wrapper and its synchronized conveyors remains in a stopped condition.

The leading article "b" on the accumulating conveyor has not reached "Strat" position 2 on the control curve, corresponding to the "Count Delay" time set into the delay circuit D. Under these conditions no delayed count Count-Up signals CU are passed on to the master up-down counter A nor to the slave counter B.

Thus there are no "actual counts" passed on to the logic control LC. The result is that a zero count output is provided by the slave counter B to the D/A counter DA and the voltage signal VS to the pulse width modulator PWM is zero.

Under these circumstances, the control signal voltage output CS of the pulse width modulator PWM is zero (see FIG. 3), as is the amplified control signal ACS for motor M3. Since the wrapper W and the infeed conveyor IC as well as the metering conveyor MC are driven by the wrapper variable speed drive WVS and the motor M3, both the wrapper and its synchoronized conveyors have stopped.

Ready to Start

Figure 4A:
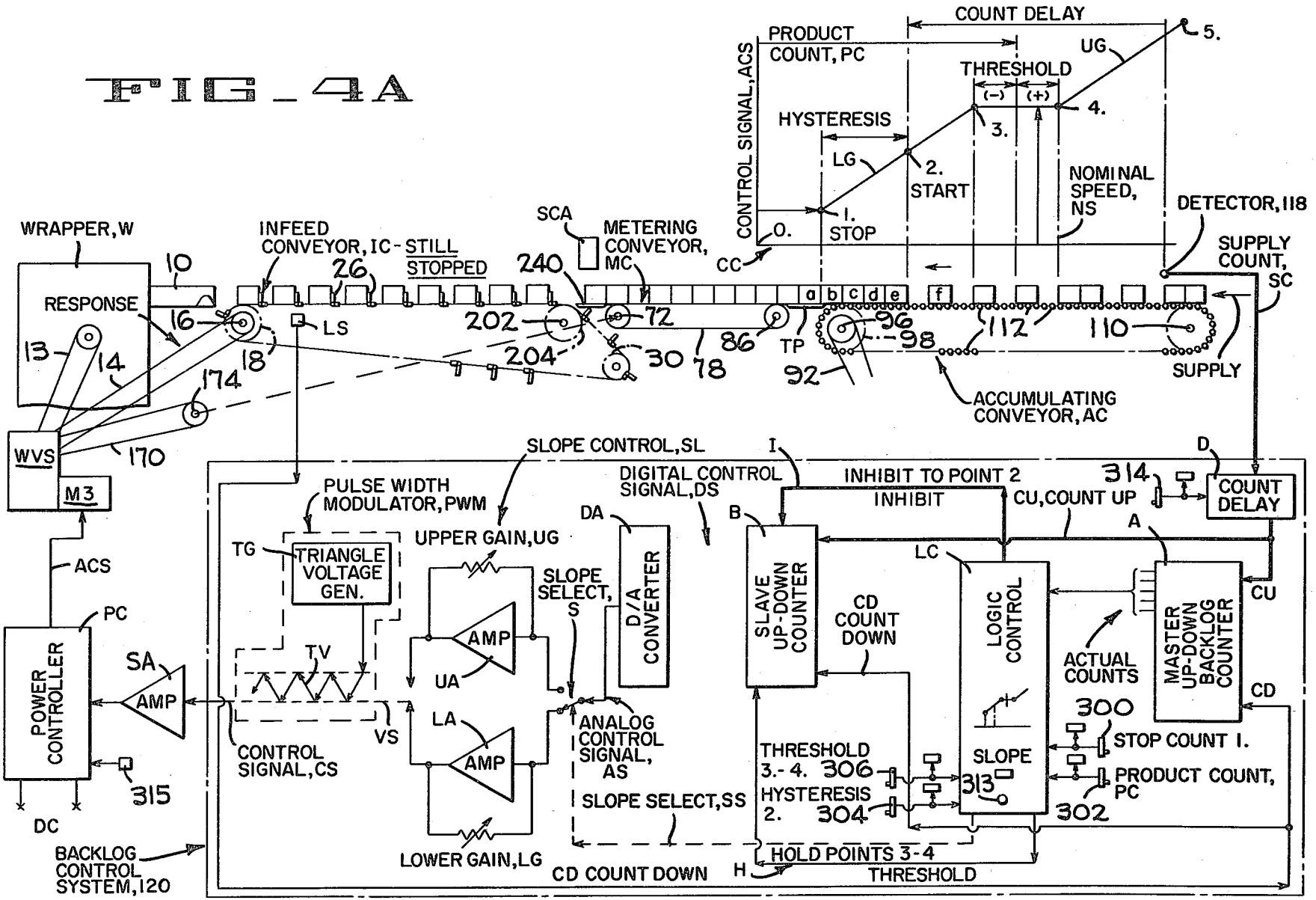
FIGS. 4A–4D are diagrams like that of FIG. 4 showing various conditions during operation of the system.

Referring to FIG. 4A, the accumulating conveyor has continued to advance articles until the leading article "b" on the accumulating conveyor has passed the count-delay or "Start" point 2, shown on the control curve but when the article "b" passed point 2, the Count-Delay circuit D delivered a count to the up-down counters A and B as a count-up count CU.

In the simplified example illustrated in FIG. 4A, four articles "b-e" have been fed past the "Start" point 2 and form a solid backlog row abutting the trailing article "a" on the transfer plate TP. The corresponding four counts have been passed on by the Count Delay circuit D to the master up-down counter A, which, in turn are sensed by the logic control LC.

The four counts have also entered the slave up-down counter, but an Inhibit signal I from the logic control LC has prevented the slave up-down counter B from passing the four counts (representing articles "b-e" in this example) from being passed on to the the D/A converter DA and no analogue control signal AS is provided.

The voltage signal VS for the pulse width modulator PWM is zero volts. Under these conditions no analogue control signal CS is provided by the pulse width modulator PWM. Thus, at this critical point, the wrapper W as well as the infeed and metering conveyors are shown as still stopped, however, backlog conditions are such that the wrapper is now in condition to be started.

Wrapper Started

Figure 4B:
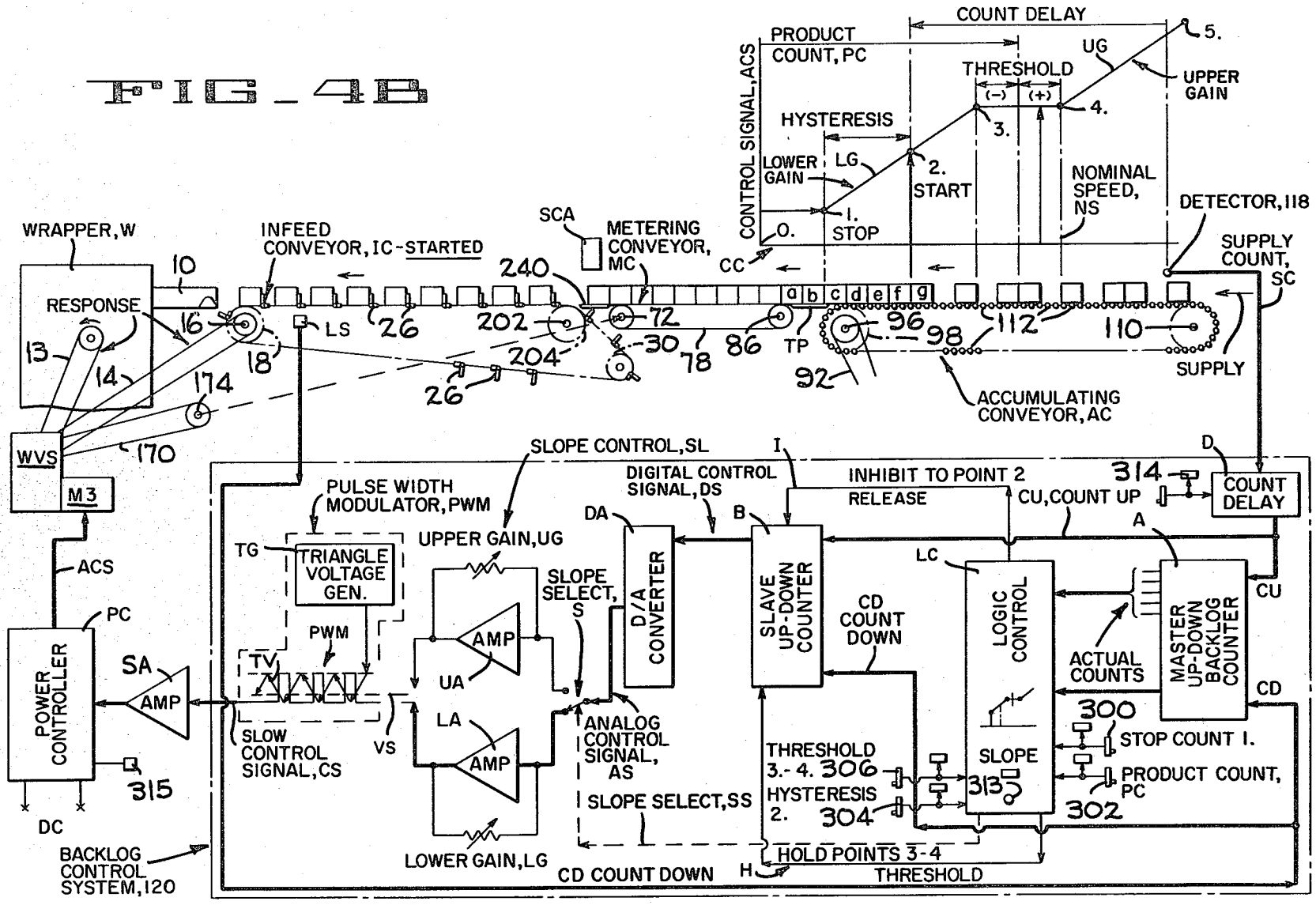
Figure 4E:
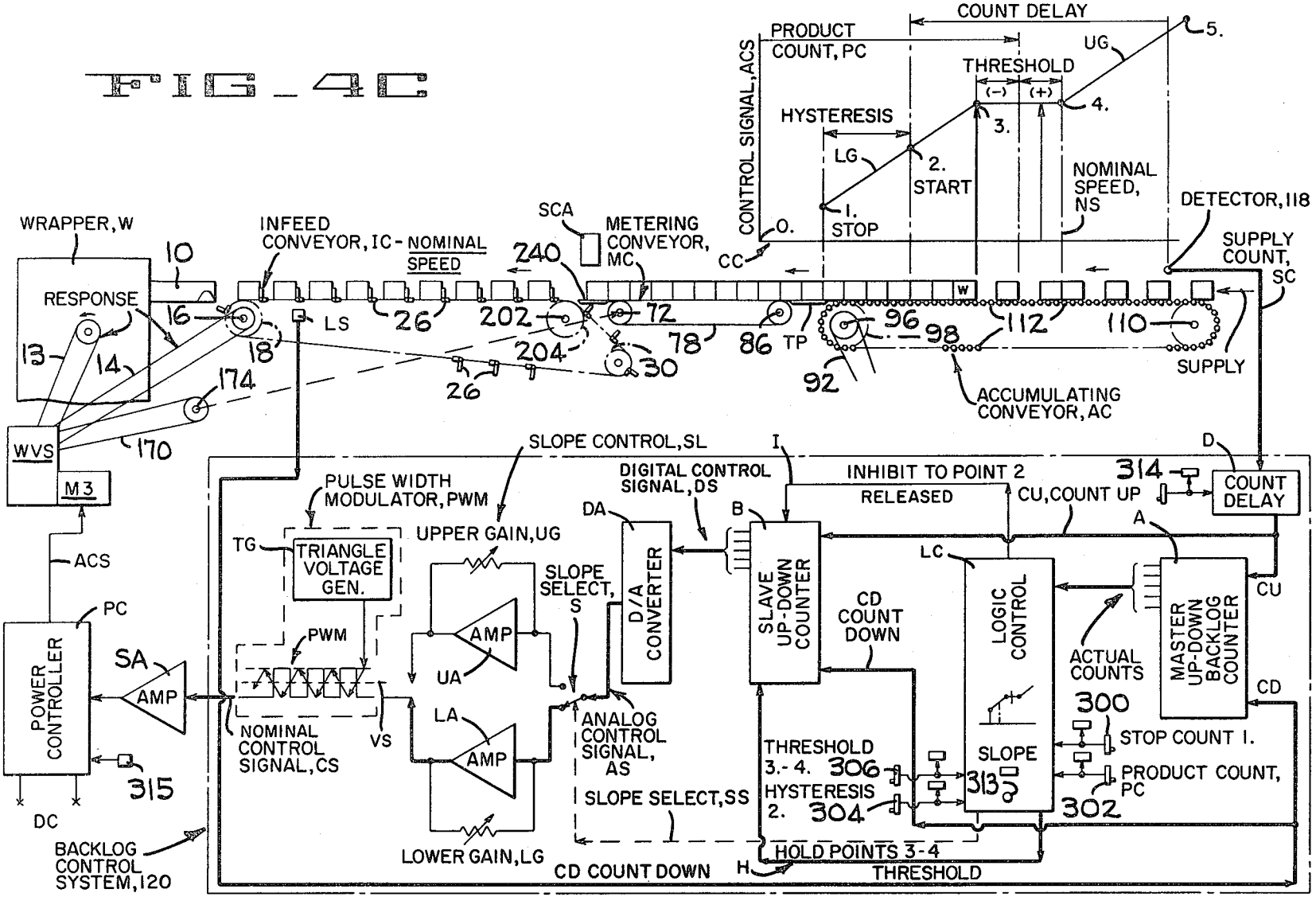
Figure 4B:
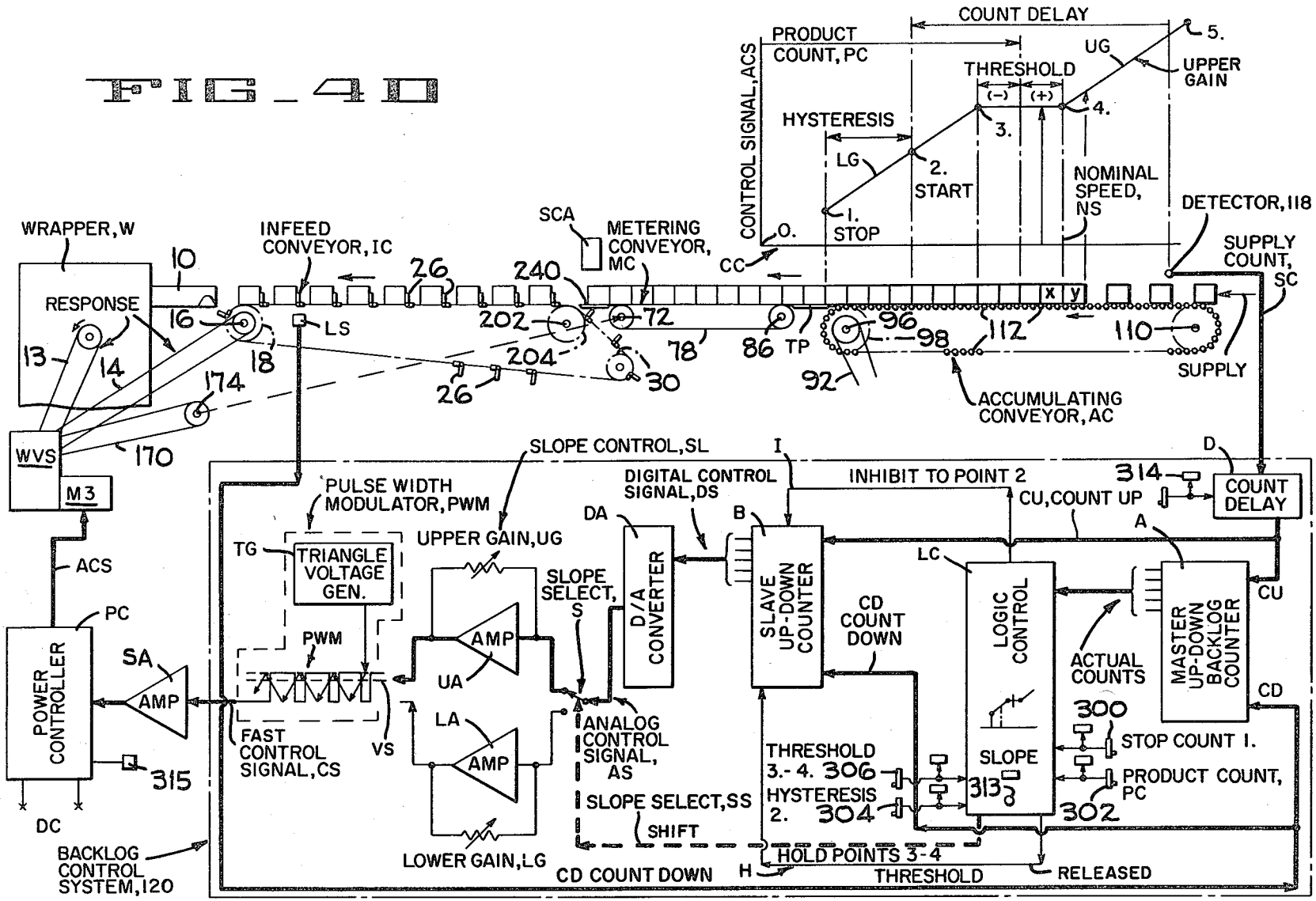

Referring to FIG. 4B, a fifth article "f" has passed the Start point 2. This count has been added (after the delay) to the up-counts previously received by the master up-down counter A. The counts in the backlog necessary to determine the count position of "Start" point 2 are set in by the setting of the Stop Count and the Hysteresis controls for the logic control LC, as can be visualized by the examination of the control curve.

The Inhibit signal I from the logic control circuit LC is now removed which releases the slave up-down counter B so that it can pass through its output which is no longer zero but represents the processing machine starting count. The D/A converter has received a count-up count from the slave counter B and converts it into the correspondingly low analogue DC control signal AS. The signal passes through the Slope Select switch SD, which has been set by the logic control LC to its lower gain position by a slope select switch signal SS from the logic control.

The amplified DC voltage signal VS, which is slightly positive in the example given, is now combined with the output of the triangle voltage generator TG in the pulse width modulator PWM, as explained in connection with FIG. 3B. The output of PWM is now a control signal CS, which is made up of a series of DC pulses, with each pulse having a short duration, (low percent modulation). When these pulses are amplified in the signal amplifier SA, they provide a low effective current control signal to the power controller PC. The latter provides a correspondingly low analogue control signal ACS to the motor M3. The wrapper and its synchronized conveyors IC and MC are now started and have started advancing articles in the backlog.

As soon as the wrapper and infeed conveyor starts, lugs 26 pass the lug sensor LS and generate count-down pulse signals CD which enter both up-down counters A and B and operate to reduce the count output of the master up-down counter A as well as the slave counter B and the digital control signal DS from counter B.

However, the backlog is still less than that represented by the nominal speed threshold point 3. Thus, under the conditions being described, the wrapper runs at a speed which is slower than its nominal speed and will continue to do so unti the backlog builds up to a pre-set count at point 3 on the control curve. At present, the rate of generation of count-down signals CD from the wrapper system is less than the rate of generation of count-up signals CU from the accumulating conveyor sensor 118 because the wrapper has not reached its predetermined nominal speed. The backlog will thus increase because the comparison of the count-up and count-down signals performed by the up-down counters provides an analogue control signal AS from the D/A converter which is lower than the normal voltage signal.

Examination of the control curve also shows that the count is at an intermediate point on the Lower Gain segment of the curve so that the output of the lower signal amplifier LA is below its maximum.

Backlog Reaches Threshold

Referring to FIG. 4C, until the wrapper and synchronized conveyors IC and MC are running at the preset nominal speed, the backlog is not being removed as rapidly as articles are supplied thereto by the accumulating conveyor.

The backlog count increases unti it reaches the threshold point 3 illustrated on the control curve. This condition is illustrated in FIG. 4C wherein article "w", the trailing article in the solid backlog, is at the threshold point 3 on the curve.

Up to this condition, the amplification of the analogue control signal AS by the lower gain amplifier LA has steadily increased. When the backlog reaches threshold point 3, the voltage signal VS to the pulse width modulator PWM will be at a selected nominal DC value. The control signal CS from the pulse width modulator will provide a pulsating direct current to the control signal amplifier SA which signal has a pulse duration (percent modulation) that is great enough to operate the wrapper motor M3 at the selected nominal speed.

The rate of the counts sent to the D/A converter a digital control signals DS, which represent the difference between a comparison of count-up counts from the count supply sensor 118 and the count-down counts from the lug sensor LS, is now momentarily stabilized at the nominal speed rate.

If the rate of articles supplied by the accumulating conveyor AC were to remain constant, the wrapper and the synchronized conveyors IC and MC would operate at a speed which removes articles from the backlog at the same rate as that which articles are supplied thereto by the accumulating conveyor.

Threshold Operation

To avoid an unnecessary increase in the number of figures of drawings, threshold operation will also be described in connection with FIG. 4C.

The provision for threshold operation forms a "plateau" for the control signal, while maintaining a safe backlog and while the wrapper is operating at its preselected nominal speed.

The threshold plateau causes the wrapper to run at its nominal speed even though the rate of articles supplied by the accumulating conveyor may vary somewhat. The threshold backlog count represents backlog conditions between points 3 and 4 on the control curve.

Thus by holding wrapper speed constant during these conditions, even though the supply or count-up rate may be changing somewhat, there is no hunting (constant changing of speed) about the selected nominal wrapper speed setting. The threshold or constant nominal wrapper speed condition, in the embodiment being described, is maintained by the generation of a "Hold" signal H by the logic control circuit LC.

The Hold signal H inhibits a change in the slave counter counts (digital control signal DS) from the slave up-down counter B so long as the backlog count is maintained at a value between that represented by points 3 and 4 on the control curve. It will be noted that the pulse width of the control signal pulses CS has now increased to some intermediate or nominal width (nominal percent modulation) with which the DC control signal current to the amplifier SA, will cause the wrapper to run at nominal speed (FIG. 3A).

In other words, so long as the rate of articles supplied by the accumulating conveyor AC (count-up CU) is adequate to prevent the backlog count from dropping below the threshold point 3 and is not so great as to cause the backlog count to exceed the threshold point 4, the count-down counts CD from the lug sensor LS can differ from the count-up supply counts SC from the count supply sensor 118 by a preselected count without causing wrapper speed to vary from its nominal speed.

In practice, the nominal speed of the wrapper drive motor M3 (FIG. 1) is adjusted in accordance with a nominal rate of articles supplied to the accumulating conveyor so that statistically, the backlog will hover around the Product Count position on the control curve. This provides an operational "cushion" which precludes frequent changes of speed of the wrapper motor M3.

Thus we have the wrapper running at selected nominal or optimum speed for the articles being wrapped, an adequate backlog is maintained at that wrapper speed and a threshold setting has been set which will prevent hunting of the control system about the selected nominal wrapping speed. The entire row of products along the accumulating conveyor, both those in the backlog and those approaching the backlog are moving and the accumulating conveyor does not bring products up against a stationary backlog.

Backlog Exceeds Threshold

Referring to FIG. 4D, article supply to the accumulating conveyor AC is rapid enough so that an article "x" in the backlog has backed up to the higher threshold count point 4. If this trend continues, the count-up signals CU to the master counter A will exceed the count-down signals CD from the lug sensor LS by an amount sufficient to cause the logic control LC to perform two functions. First, the threshold "Hold" signal H is released, permitting the slave counter B to pass on additional counts CU to the D/A converter DA. Second, a switch S which shifts the switch to connect the analogue control signal AS from the D/A converter to the upper amplifier UA of the slope control circuit SL.

Wrapper speed can now vary in accordance with the variations in the output of the slave counter B and with the gain of the upper gain amplifier UA. In FIG. 4D, the article supply rate is high enough so that the trailing article "y" of the backlog is at a point on the control curve which is at a lower zone of the Upper Gain slope portion of the curve. Thus the analogue control signal AS from the D/A converter passes through the upper gain amplifier UA to produce a voltage signal VS for the pulse width modulator PWM that is more positive than before. The percent pulse width modulation is now increased to a value greater than that representing nominal speed and the amplified control current signal ACS increases the speed of the wrapper and its synchronized conveyors.

As the wrapper speed increases, the rate of count-down counts CD from the lug sensor increases correspondingly. If the new and increased supply rate is maintained, the accumulated count difference between the count-up and count-down counts in the slave counter B will soon provide a steady state digital control signal DS which will maintain the backlog at the point on the control curve represented by the article "y".

If the supply rate of articles to the accumulating conveyor continues to increase, the number of count-up pulses or counts CU over a given period of time also increases. The resultant comparison with the count-down counts CD in the counters A and B sends a high count digital control signal voltage DS to the D/A converter. The latter provides a more positive analogue control voltage signal VS to the upper gain amplifier and on to the pulse width modulator PWM. The percent pulse width modulation is thus increased still further and the resultant control current signal ACS causes wrapper speed to increase correspondingly, thereby holding the backlog (which is now somewhat greater) at a higher point on the upper gain slope, not illustrated in FIG. 4D. Again, the count comparison made in the counters A and B will hold wrapper speed at its new high speed so long as the rate of count supply counts SC also remains at the aforesaid increased value.

Slowing Down And Stopping

Wrapper speed automatically and continuously decreases as the rate of supply pulses or counts SC from the acculumating conveyor sensor 118 decreases. Under these conditions and in a given period of time, the number of count-down counts CD will exceed the number of count-up counts CU. The resultant counts in the counters A and B reduce the number of counts forming the outputs of these comparators.

The effect of decreasing supply counts SC on wrapper speed can be explained by first assuming a backlog condition relative to the control curve. An excess of count-down counts CD reduces the number of counts from counter B representing the digital control signal DS to the D/A converter. This in turn reduces the wrapper speed in the manner analogous to that by which wrapper speed was increased.

If the backlog had been in a position corresponding to the upper gain slope on the control curve, the decreased article supply count rate would cause the wrapper to operate at a lower speed because the comparison of count-up counts with count-down counts will be dominated by the latter, and the digital control signal DS resulting from that comparison will contain fewer counts. The backlog is being steadily reduced.

The backlog will soon reach the point 4 position on the control curve, at which time a "Hold" signal H is re-introduced by the logic control LC to the slave counter B. Wrapper speed will now remain constant, but the backlog is further decreased until the backlog reaches point 3 on the control curve. At this point, a "Slope Select" signal SS is developed in the logic control LC which signal resets the slope select switch SS to the lower gain amplifier LA.

The "Hold" signal from the logic control LC is also removed at point 3, permitting th digital control count comparison signal counts DS (being reduced in number) to be passed on to the D/A converter from the slave counter B. If the article supply count rate SC remains small or if it has ceased, the wrapper speed not progressively decreases (pulse width modulation percent decreases) along the lower gain slope of the control curve, providing a continued reduction in the backlog. If the article supply to the accumulating conveyor has stopped, there will be no supply counts SC entering the time delay D. However, the wrapper remains running because of the counts CU previously stored in the counters A and B which have not been offset by count-down counts CD from the lug sensor LS.

The backlog continues to decrease along the lower gain slope of the control curve decreasing below the count represented by the Start point 2 on the curve. The wrapper speed is below its nominal speed but the wrapper will remain running until the wrapper has decreased the backlog to the Stop point 1 on the control curve. The control signal voltage VS will now be zero. The pulse modulation width in the pulse width modulator PWM will be zero percent, no control signal current CS is generated and the wrapper and synchronized conveyors IC and MC will stop. Referring to FIG. 4 in the example given, the trailing article in the backlog will be at the position of article "a" resting on the transfer plate TP.

The wrapper remains stopped until a few articles, representing a number of articles set in by the Hysteresis control, have backed up on the accumulating conveyor. When this condition has been reached a Start signal at point 2 on the control curve will be generated as previously described and the wrapper, the infeed conveyor and the metering conveyor will all be started. From this point on additional articles being added to the backlog by the accumulating conveyor will be advanced against a backlog which is being moved along by the metering conveyor and the infeed conveyor. Thus, when operation is resumed the speed differential between the accumulating conveyor and the metering conveyor is again reduced because of the moving backlog and the tendency of articles to shuffle or overlap in the backlog is correspondingly reduced.

In some situations it has been found that smooth operation, without undesirable hunting about a control point is attainable by reducing the threshold count to a small number, or even to zero. This zero threshold setting reduces the control curve to two straight lines intersecting at a point when upper and lower gain settings are unequal. The control curve becomes one straight line if a zero threshold setting is utilized in conjunction with equal settings for upper and lower gain. However, even with these described particular situations and settings, the basic principle of operation of the backlog control system remains unchanged.

Modified Form

Figures 5, 5A:
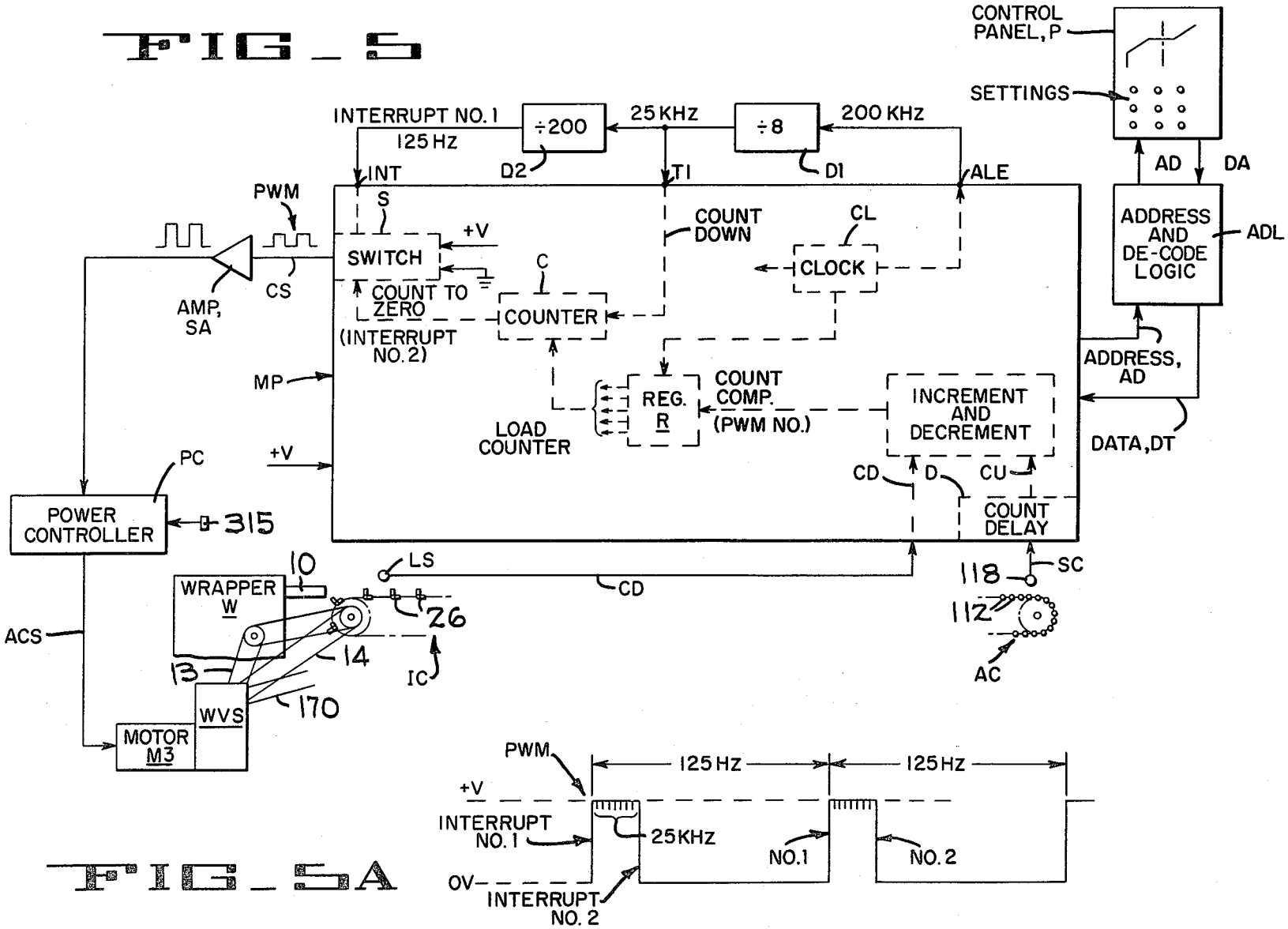
FIG. 5 is a schematic diagram of a modified form of the invention which employs a microprocessor.
FIG. 5A shows the pulse width modulation signal.

FIGS. 5 and 5A show schematically a modified form of the system wherein a microprocessor is employed to perform all controls.

Microprocessors contain systems of a general nature including memory circuits which can be programmed to perform selected operations and functions. They can be interfaced with analogue control settings (count switches in the present invention) by an address and decode logic system or the like, the details of which depend upon the nature of the control inputs and of the microprocessor. Microprocessor operations are sequenced by pulses from an internal clock.

The functions to be performed by a microprocessor are determined by the entry of a program (software) into the processor and the processor continuously executes a series of operations required by the program. In reality, the microprocessor does not contain "hard wired" functional units that are designed for specific operations and hence a detailed explanation of the operation of such a processor requires tracing through an entire program, step by step.

At the present state of the art, electrical engineers, and programmers are capable of translating a desired ultimate mode of operation or result into a microprocessor (or computer) program. Hence, if the principles and nature of desired results as microprocessor outputs are given, the presentation of an entire detailed program for causing the microprocessor to operate on such principles and produce the desired results is not usually necessary in order to provide those skilled in the art with sufficient information to draw up such a program.

In the diagram of FIG. 5, a "symbolic convention" is employed to assist in an explanation of how the microprocessor generates pulse width modultion signals PWM. The convention incorporates the use of explanatory (but physically non-existent as such) "hard wired" symbolic units to explain certain basic functions or subroutines that are carried out in response to the program. The fact that such units are not physically wired in does not alter the fact that their designtions serve not only as an explanation of the microprocessor function but as directions for an experienced programmer.

Referring to FIG. 5, a microprocessor MP is programmed to produce a pulse width modulation PWM signal CS based on count supply counts SC from the supply sensor 118 and count down counts CD from the lug sensor LS. The microprocessor also operates in accordance with settings of count switch numbers at the control panel P. The lower end upper gain settings LG and UG represent multiplying constants of the slope count, as before. However, in this case these inputs are introduced as numbers instead of as amplifier gain controls. The microprocessor MP of FIG. 5 operates on the same basic principle as those that underlie the operation of the control system 120, previously described, but in a manner which is characteristic of the continuously pulsed interrogation and response procedures carried out by a programmed microprocessor.

The program requirements for obtaining the desired end results of the present system, once they are given along with the principles of their derivation, are within the capabilities of one skilled in the art. In fact, the generation of a program which will provide the Count Delay function, Stop and Start counts, Product Count, Hysteresis Count, Threshold Count and the count comparison functions (increment and decrement) requires no more than ordinary programming skill, once the inputs and the end results are laid down. Hence, no attempt has been made to explain the principles whereby the microprocessor generates these and other functions.

Although there may be several methods of programming a microprocessor to produce a pulse width modulation output signal, in accordance with the principles of the present invention, FIG. 5 represents an explanation of one type of program for this purpose, employing the aforesaid symbolic convention.

Referring to FIG. 5, the control panel P has provisions for various data settings as previously described, except that the gain settings are also introduced as numbers. The control panel is interfaced with a microprocessor MP by an address and decode logic unit ADL. This unit makes it possible for the microprocessor to sequentially address the control panel digital switches by an address line AD, sense the data set therein, and return such data by a data line DT to the microprocessor. The microprocessor also receives supply counts SC from the sensor 118 at the accumulating conveyor AC as well as count down counts CD on the lug sensor LS at the infeed conveyor IC, as in the system previously described.

Adopting the aforesaid convention, shown within the microprocessor MP is a Count Delay sub-routine D which receives the supply count signal pulses SC and provides the delayed count up pulses CU for the purposes previously described. The count up pulses CU and the count down pulses CD from the lug sensor LS are programmed in an Increment and Decrement subroutine, the output of which represents the accumulated count difference counts corresponding to those from the slave up down counter B in the system previously described. The count comparison counts have been characterized as representing the PWM number in the microprocessor.

The difference counts are shown as entering a register R which merely represents the existence of means for temporarily storing these counts for utilization as required for computing the pulse width modulation signal. At predetermined intervals the count comparison counts from the register R load a counter C and the counter C is periodically pulsed so that its output counts down from the input value to zero by a count down input from a terminal T1 of the microprocessor which provides pulses at 25 KHz. The 25 KHz pulses are received from a terminal ALE of the microprocessor which provides pulses at 200 KHz. These pulses are divided by eight in the divider D1 to produce pulses at 25 KHz which are directed to the aforesaid microprocessor terminal T1 and serve as count down pulses.

The 25 KHz pulses are also directed to a divider D2 which divides them by 200 and reduces pulses at 125 Hz which pulses are directed to an interrupt terminal INT of the microprocessor.

The 125 Hz pulses provide interrupt No. 1 signals to the switch S and when the counter C counts down to zero it provides an interrupt No. 2 signal to the same switch. The interrupt No. 1 signal causes the output CS of the switch to be at a positive voltage. When an interrupt No. 2 signal is introduced to the switch S from the counter C, after the counter is counted down to zero at the 25 KHz rate, the output voltage of the switch drops to zero volts.

The aforesaid operation of the switch explains the generation of the pulse width modulation signal PWM as illustrated in FIG. 5A. As can be seen in this figure, the signal varies from zero volts to some positive voltage +V. When interrupt No. 1 pulse is received from the divider D2 the signal voltage rises from zero to a positive voltage value. The signal is maintained at this value until an interrupt No. 2 pulse is generated by the counter C when the counter counts down to zero. When the latter pulse is received by the switch, the output of the switch is returned to zero volts and the period of time during which the voltage signal was high is a function of the number of counts stored in the counter C. When the next 125 Hz signal is received, the interrupt No. 1 signal causes the switch output voltage to go positive again and this positive voltage is terminated upon generation of the interrupt No. 2 signal in the manner just described.

If better resolution (finer control) is desired, the frequency of the pulses controlling the counter C can be increased. The examples given of 25 KHz and 125 Hz give 1/200 or $\frac{1}{2}$% resolution. If the 25 KHz pulses were changed to 50 KHz pulses the resolution would be correspondingly finer.

A microprocessor suitable for use in the system shown in FIG. 5 is the Intel Model 8039, manufactured by the Intel Corporation of Santa Clara, California.

Referring again to FIG. 5, the pulse width modulation signal CS in the microprocessor MP enters a signal amplifier SA that sends amplified pulse width modulation signals to a power controller PC in the manner of the system previously described.

The power controller PC sends an amplified control signal ACS to the motor M3 which drives the drive WVS for the wrapper W, the infeed conveyor IC and the metering conveyor (not shown) as before.

Having completed a detailed description of the two embodiments of the present invention it can be seen that both control the backlog on the basis of counting articles or products being supplied to the backlog, counting them as they are removed from the backlog for processing, taking the difference between these counts and controlling the speed of the processing machine on the basis of the count difference.

It can also be seen that in normal operation, the control system is a closed loop or automatic servo system. So long as the backlog is within the limits of the control curve settings (greater than the Stop Count and not greater than an upper limit count at point 5), the system continuously matches processing machine speed to the average rate at which articles are supplied to the backlog. For example, assume that the article supply rate exceeds that represented by the Nominal Speed setting for an appreciable length of time so that the backlog builds up to a point corresponding to a count above point 4 on the control curve. The processing machine speed will be automatically adjusted to hold the backlog at the aforesaid point by removing articles from the larger than normal backlog as fast as they are supplied thereto at the aforesaid higher than nominal rate.

Although the best mode contemplated for carrying out the present invention has been herein shown and described, it will be apparent that modification and variation may be made without departing from what is regarded to be the subject matter of the invention as defined in the appended claims.

What we claim is:

1. The method of controlling a backlog of articles supplied to a variable speed article processing machine; said method comprising the steps of serially removing unprocessed articles from the backlog and introducing them to the machine at a rate that is synchronized with machine speed, effecting a count corresponding to each article being removed from the backlog, randomly supplying unprocessed articles to a conveyor for addition to the backlog, counting each article being thus supplied at a point upstream of a selected maximum backlog position, delaying the transmission of each article supply count by a length of time equal to that required for the conveyor to transport an article from said upstream point to said selected backlog position for providing a delayed count, taking the difference between said delayed counts and said backlog removal counts and controlling machine speed on the basis of said count difference.

2. The method of controlling a backlog of articles supplied to a variable speed article processing machine; said method comprising the steps of serially removing unprocessed articles from the backlog and introducing them to the machine at a rate that is synchronized with machine speed, effecting a serial count corresponding to each article being removed from the backlog, randomly supplying unprocessed articles for addition to the backlog, counting each article being thus supplied, continuously subtracting the removal counts from the supply counts to produce a count difference, selecting a predetermined nominal product count for articles in the backlog, selecting a predetermined threshold range of article counts that include said nominal product count, controlling machine speed on the basis of said count difference to produce a first machine speed in response to a count difference below said threshold range of counts, a second machine speed greater than said first machine speed in response to count differences in said threshold range of counts, and a third machine speed greater than said second machine speed in response to a count difference greater than said threshold range of counts, and inhibiting variations in machine speed while the article backlog count remains in said threshold range.

3. The method of controlling a backlog of articles according to claim 2 wherein said step of controlling machine speed includes producing a first machine speed which is variable through a range below said second machine speed, and producing a third machine speed which is variable through a range above said second machine speed.

4. The method of controlling a backlog of articles according to claim 2 including the further steps of selecting a predetermined minimum backlog article count, and stopping the machine when said count difference drops below said minimum.

5. Apparatus for feeding unprocessed articles from a backlog to a variable speed article processing machine and having a backlog control system for determining the length of said backlog row, comprising:

means for delivering articles to said machine from said backlog row at a speed synchronized with that of said machine, means for effecting a count corresponding to each of said delivered articles, means for randomly supplying articles to said backlog row, means for counting each of said supplied articles, means for introducing a predetermined nominal product count for articles in the backlog into the system, means for introducing a selected threshold range of counts that includes said nominal product count, means for continuously subtracting one of said article counts from the other to produce a count difference, means for controlling machine speed on the basis of said difference between article counts including means for producing a first machine speed in response to a count difference below said threshold range of counts, means for producing a second machine speed greater than said first machine speed in response to count differences in said threshold range of counts, and means for producing a third machine speed greater than said second machine speed in response to a count difference greater than said threshold range of counts, and means for inhibiting variations in machine speed while the backlog count remains in said threshold range.

6. The backlog control apparatus of claim 5 wherein said means for producing a first machine speed further includes means for producing a range of speeds below said second machine speed, and said means for producing a third machine speed further includes means for producing a range of speeds above said second machine speed.

7. The system of claim 5; comprising means for introducing a minimum backlog article count into said system, and means for stopping said machine when the backlog count drops below said minimum.

8. In a system for maintaining a backlog of unprocessed articles for delivery to an article processing machine; accumulator conveyor means for receiving randomly supplied unprocessed articles and bringing them to the trailing end of the backlog, means for counting each randomly supplied article at an upstream position on said conveyor means, count delay means for receiving each article supply count, said delay means having means for receiving article supply counts and means for providing corresponding counts after a time delay period, said time delay period corresponding to the time required for said accumulator conveyor means to transport an article from said upstream counting position on said conveyor means to a selected downstream position of backing formation, means effecting a delivery count corresponding to each article delivered to said processing machine, and means for controlling processing machine speed in response to the difference between said delivery counts and said delayed article upstream counts.

9. In a system for maintaining a backlog of unprocessed articles for delivery to an article processing machine infeed conveyor; infeed conveyor means for delivering articles to the machine at a uniform spacing and at a speed synchronized with that of said machine, means for effecting a count corresponding to each article delivered by said infeed conveyor means, backlog replenishing conveyor means for receiving randomly supplied unprocessed articles and adding them to the backlog, means for counting each randomly supplied article at an upstream position on said backlog replenishing conveyor means, count delay means for receiving each article count, said delay means having means for releasing a delayed count that represents a previous article supply count but is not released until after a time delay period, said time delay period corresponding to the time required for said accumulator conveyor means to transport an article from said upstream counting position on said conveyor means to a selected downstream position of backlog formation, means for subtracting said article delivery counts from said delayed counts, and means for controlling processing machine speed on the basis of said count subtraction.

* * * * *